US007290375B2

(12) United States Patent
Kemeny

(10) Patent No.: US 7,290,375 B2
(45) Date of Patent: Nov. 6, 2007

(54) SEISMIC ISOLATION ACCESS FLOOR ASSEMBLY

(76) Inventor: Zoltan Kemeny, 1809 E. Lavieve La., Tempe, AZ (US) 85284

( * ) Notice: Subject to any disclaimer, the term of this patent is extended or adjusted under 35 U.S.C. 154(b) by 44 days.

(21) Appl. No.: 11/208,584

(22) Filed: Aug. 22, 2005

(65) Prior Publication Data

US 2006/0191213 A1 Aug. 31, 2006

Related U.S. Application Data

(60) Provisional application No. 60/651,976, filed on Feb. 14, 2005.

(51) Int. Cl.
*E04B 1/98* (2006.01)
*E04H 9/02* (2006.01)

(52) U.S. Cl. ..... 52/167.1; 52/167.4; 52/167.5; 52/167.6; 52/263; 52/506.06

(58) Field of Classification Search ..... 52/167.1, 52/167.4, 167.5, 167.7, 167.6, 167.8, 167.9, 52/263, 506.06; 248/580
See application file for complete search history.

(56) References Cited

U.S. PATENT DOCUMENTS

| | | | | |
|---|---|---|---|---|
| 99,973 | A * | 2/1870 | Touaillon | 52/167.5 |
| 2,014,643 | A * | 9/1935 | Bakker | 384/49 |
| 5,452,548 | A * | 9/1995 | Kwon | 52/167.8 |
| 5,913,503 | A * | 6/1999 | Satoh et al. | 248/636 |
| 2005/0241245 | A1* | 11/2005 | Tsai | 52/167.1 |

* cited by examiner

*Primary Examiner*—Jeanette Chapman
(74) *Attorney, Agent, or Firm*—Parsons & Goltry; Michael W. Goltry; Robert A. Parsons

(57) ABSTRACT

An access floor assembly includes a base floor, a substructure mounted to the base floor, a bearing plate, formed with a first cavity, mounted to the substructure and disposed at an elevated location relative to the base floor, an isolator plate, formed with a second cavity, overlying the bearing plate, a ball disposed between the bearing plate and the isolator plate contacting the first and second cavities, and a floor plate coupled to the isolator plate and together forming an access floor disposed at an elevated location relative to the base floor.

27 Claims, 16 Drawing Sheets

SEISMIC ISOLATION ACCESS FLOOR ASSEMBLY

CROSS-REFERENCE TO RELATED APPLICATION

This application claims the benefit of U.S. Provisional Patent Application Ser. No. 60/651,976, filed Feb. 14, 2005.

FIELD OF THE INVENTION

The present invention relates to raised access floors and, more particularly, to raised access floors with seismic isolation capabilities.

BACKGROUND OF THE INVENTION

Access floors are raised above base floors typically fashioned of concrete, and provide access for cables, pipes, ducts and other utility or supply lines, equipment, and equipment hookups. Access floors are normally made of large, lightweight floor plates supported by a supporting substructure positioned on the base floor. Typical substructures incorporate pedestals and/or stringers. In most instances the pedestals of known substructures are braced to the base floor and/or to each other, which transfers lateral loads between the floor plates and stringers and the base floor. Lateral loads can originate above the access floor in some instances, such as from the rolling resistance of equipment moving thereacross. Seismic load is mainly a lateral load, which originates on the base floor and is transmitted to the access floor through the substructure supporting it above the base floor, and further to equipment resting on the access floor.

Existing raised access floors and their associated supporting substructures prove adequate, but it has been noticed that known raised access floors actually amplify base floor accelerations, which often results in damage to equipment and fixtures positioned thereon, such as server racks, main frame computers, electronics cabinets, semiconductor tools and manufacturing equipment, etc., which is obviously problematic, especially when such access floors are installed in geographical areas prone to seismic activity. Although there has long been a need in the art to provide a seismically-isolated raised access floor, none that is practical and economically feasible has yet been introduced in the art. Although some skilled artisans have attempted to isolate access floors by mounting the understructure over heavy-duty steel or aluminum or sheet metal framing of beams and columns and large seismic isolators, this structure not only does not satisfactorily provide the desired seismic isolation, but also encroaches into most of the usable access space and is complicated to build and install, expensive, and imposes large punching shear on the concrete floor, and thus proving to be unworkable and impracticable in the marketplace.

SUMMARY OF THE INVENTION

According to the invention, there is provided a seismic isolation access floor assembly including a base floor, a bearing plate coupled to the base floor, an isolator plate overlying the bearing plate, and a ball disposed between and contacting the bearing plate and the isolator plate. A floor plate is coupled to the isolator plate and together with the isolator plate forms an access floor disposed at an elevated location relative to the base floor. In a particular embodiment, there is a frame coupled to the isolator plate, and which is capable of receiving and supporting a floor plate, in which in a particular embodiment there is a floor plate supported by the frame. Further to the present invention is a substructure mounted to the base floor, and the bearing plate is mounted to the substructure and disposed at an elevated location relative to the base floor. The substructure consists of at least one upstanding pedestal having an end coupled to the base floor and an opposing end coupled to the bearing plate. The pedestal is adjustable between shortened and lengthened conditions. A first cavity is formed into the bearing plate, a second cavity is formed into the isolator plate, the first cavity confronts the second cavity, and the ball contacts first and second cavities. Preferably, the first and second cavities are each concave.

According to the principle of the invention, there is provided a seismic isolation access floor assembly including a base floor, a bearing plate coupled to the base floor, an isolator plate overlying the bearing plate, a ball disposed between and contacting the bearing plate and the isolator plate, and a first floor plate coupled to the isolator plate and together forming an access floor disposed at an elevated location relative to the base floor. Further to the present embodiment is a frame coupled to the isolation plate, and the first floor plate supported by the frame. A floor plate receiving frame is coupled to the isolator plate, a second floor plate is supported by the floor plate receiving frame. A substructure is mounted to the base floor, and the bearing plate is mounted to the substructure and is disposed at an elevated location relative to the base floor. The substructure includes at least one upstanding pedestal having an end coupled to the base floor and an opposing end coupled to the bearing plate. The pedestal is adjustable between shortened and lengthened conditions. A first cavity formed into the bearing plate, a second cavity formed into the isolator plate, the first cavity confronting the second cavity, and the ball contacts the first and second cavities. The first and second cavities are each concave.

According to the invention, there is provided an assembly of attached isolator plates and floor plates together forming an access floor disposed at an elevated location relative to a base floor, in which each of the isolator plates overlies a bearing plate coupled to a base floor and which is formed with a first cavity contacting a ball disposed on an opposed second cavity formed in the bearing plate. The bearing plate associated with each of the isolator plates is mounted to a substructure coupled to the base floor, in which the substructure consists of at least one pedestal. The pedestal is adjustable between shortened and lengthened conditions, and the first and second cavities are each preferably concave. In a particular embodiment, a frame attached to at least one of the isolator plates, and one of the floor plates is supported by the frame.

Consistent with the foregoing summary of preferred embodiments and the ensuing disclosure of the invention, which are to be taken together as the disclosure of the invention, the invention also contemplates other apparatus and method embodiments.

BRIEF DESCRIPTION OF THE DRAWINGS

Referring to the drawings.

DETAILED DESCRIPTION OF PREFERRED EMBODIMENTS

Seismic isolation access floor assemblies are disclosed, which incorporate an access floor consisting of an assemblage of plates including seismically isolated plates assembled in conjunction with floor plates and which are low in cost, which are safe, in which the isolator plates each are inexpensively and efficiently seismically isolated to a base floor and that when displaced are able to restore themselves to their original positions efficiently and automatically.

Figure 1:
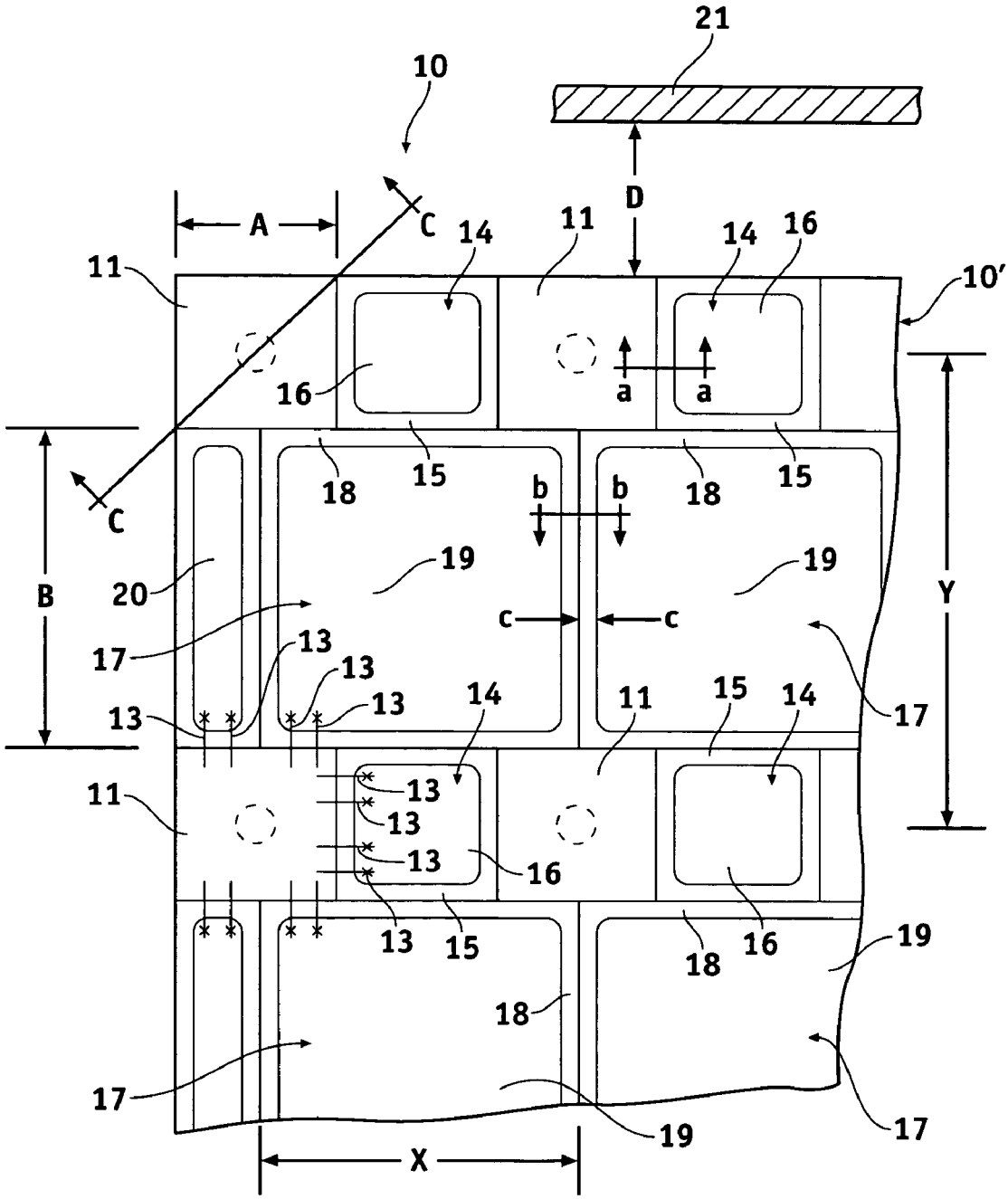
FIG. 1 is a top plan view of a seismic isolation access floor assembly, which is constructed and arranged in accordance with a preferred embodiment of the invention.

Referring now to the drawings, in which like reference characters indicate corresponding elements throughout the several views and sections, attention is first directed to FIG. 1 in which there is seen a top plan view of a seismic isolation access floor assembly 10 including isolator plates 11 and a series of floor plates, which are denoted, as a matter of reference, at 14, 16, 17, 19, and 20, and that together with the isolator plates form an access floor 10' constructed and arranged in accordance with the principle of the invention. Isolator floor plates 11, and the structure associated therewith to be presently described, each constitute a seismic isolation component of assembly 10 together providing assembly 10 as a whole and, more over, access floor 10', with seismic isolation, in accordance with the principle of the invention. In FIG. 1, only a portion of access floor assembly 10 is shown, with the understanding that the components of access floor assembly 10 can be multiplied as need for providing an access floor having any specified surface area.

Isolator plates 11 are laid down in basically a two way array of separation, in which this separation is denoted generally by separation distances denoted at X and Y, respectively, in conjunction with the remaining floor plates 14, 16, 17, 19, and 20 of assembly 10. In this preferred embodiment, isolator plates 11 are square, and each have a relative size indicated generally at A and which is indicative of the length thereof, and also the width thereof given the square shape of each isolator plate. In accordance with the principle of the invention, isolator plates 11 each rest on a ball 12, in which balls 12 are each depicted in phantom outline in FIG. 1. Fasteners, designated generally at 13 and which are each bolts in a preferred embodiment, rigidly attach plates 11 to floor plates 14, 17, 19, and 20. Again, it is to be understood that a matrix of attached isolator plates 11 and floor plates 14, 16, 17, 19, and 20 forms access floor 10', in accordance with the principle of the invention.

Here, floor plate 17 is square, has a relative size indicated at B and is fashioned with a perimeter frame 18 onto which is removably set plate 19. In this regard, it is to be understood that plate 19 when set onto perimeter frame 18 of plate 17 together form a floor plate assembly. The size of plate 17 indicated at B is indicative of its length, and also its width given its square shape. Perimeter frame 18, which is considered a stringer, is secured to isolator plate 11. Similarly, floor plate 14 is also fashioned with a perimeter frame 15, onto which is removably set plate 16. In this regard, it is to be understood that plate 16 when set onto perimeter frame 15 of plate 14 together form a floor plate assembly. The width of the perimeter frames of the floor plates here described is denoted here generally at C, which is very small compared to size B and is comparable to the thickness of floor plates 14, 17, 19 and 20, and isolation isolator plate 11 being that of approximately 1.5 inches.

Figure 4:
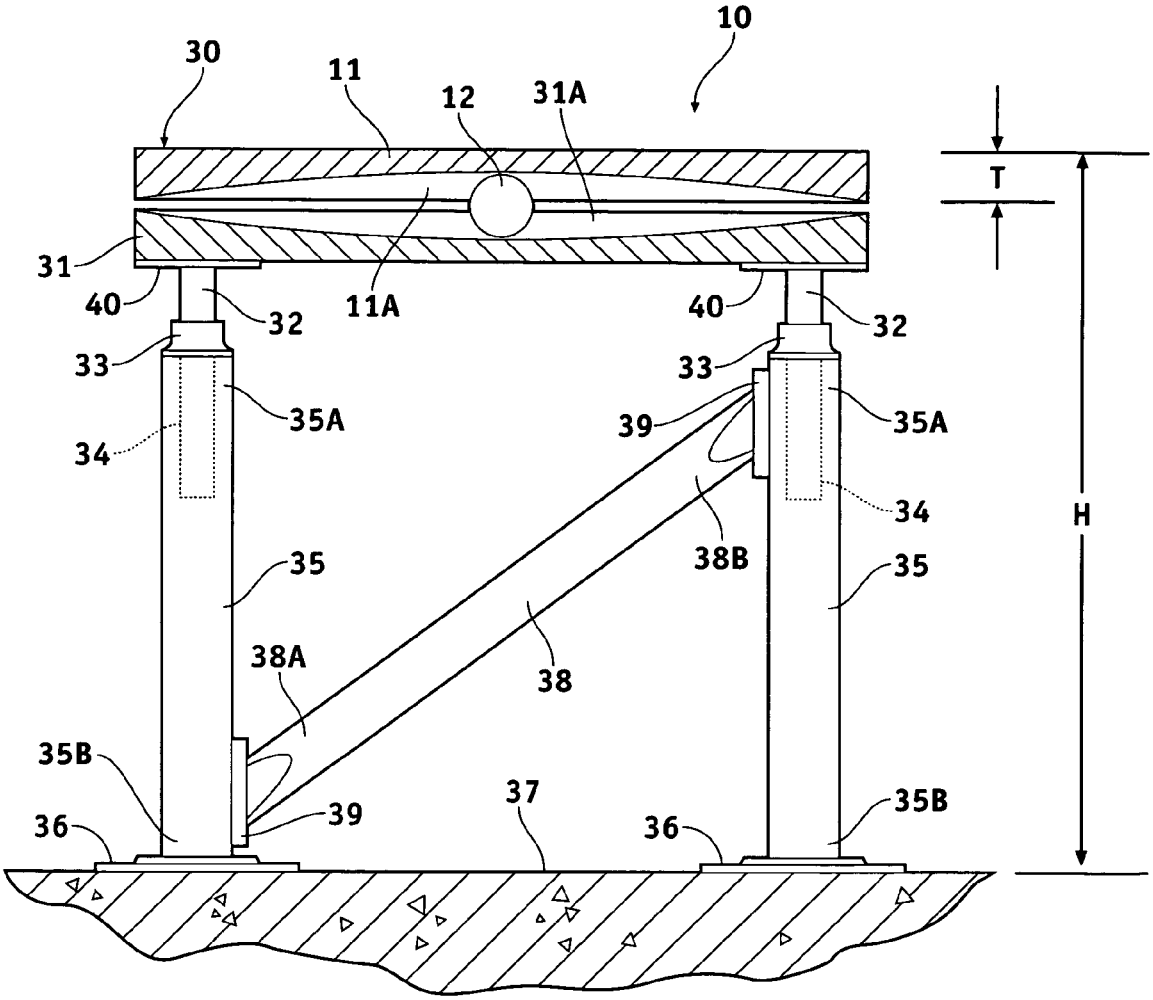
FIG. 4 is a sectional view taken along line c-c of FIG. 1.

Assembly 10 is separated from a wall 21 a distance denoted by D, in which wall 21 is a stationary wall built over a base floor, which is referenced in FIG. 4 at 37. The base floor, which is preferably a concrete base floor, supports a substructure, which in turn supports access floor 10'. When seismic activity shakes the base floor, isolator plates 11, and the structure associated therewith to be presently described allows, permits access floor 10' as a whole to displace and move laterally or otherwise horizontally relative to the base floor from its normal resting state and then restore to its normal resting state after the movement activity discontinues thereby providing access floor 10' with seismic isolation.

Figure 2:
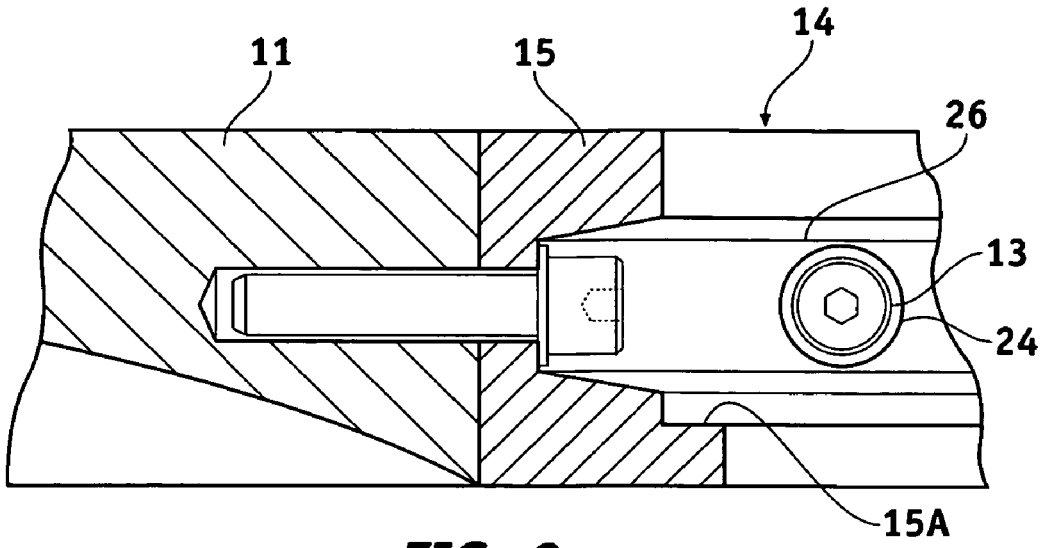
FIG. 2 is a sectional view taken along line a-a of FIG. 1.
Figure 3:
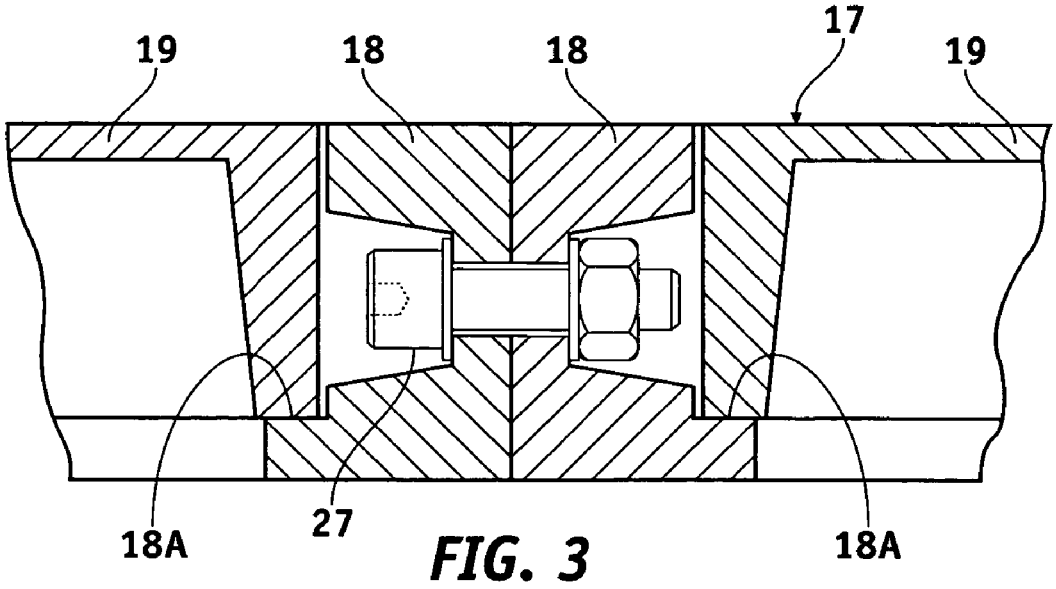
FIG. 3 is a sectional view taken along line b-b of FIG. 1.

The ensuing sectional views set forth in FIGS. 2 and 3 illustrate the connections between the plates of assembly 10, in which the plates of assembly 10 have load bearing capacity and in-plane and out-of-plane rigidity across the components and connections thereof.

Turning first to FIG. 2, which is a sectional view taken along line a-a of FIG. 1, there is illustrated a connection point between isolator plate 11 and floor plate 14, with the understanding the a plurality of such connection points are used in conjunction therewith, in which the structure of only one connection point is shown for illustrative purposes. In FIG. 2, perimeter frame 15 is fastened to isolator plate 11 with a fastener, which in this instance is a bolt 23, although a cap screw or other suitable mechanical fastener can be used, if desired. Perpendicularly disposed relative to bolt 23 is another fastener secured to an adjacent floor plate (not shown), which in this instance is bolt 13 incorporating a lock washer 24. In this embodiment, perimeter frame 15 has an inwardly directed flange or lip 15A, onto which is set plate 16 (not shown), and onto which equipment is to be set.

According to the principle of the invention, each isolator plate 11 is the upper part of a seismic isolator component of the invention, which is formed with a concave cavity 11A that is recessed upwardly. There is no appreciable gap between plate 11 and frame 15, and in this moment connection bolt 23 bears the tension and the compression is transferred on the top and the bottom part of the mating surfaces of plate 11 and frame 15 providing seismic isolation to isolator plate 11 and also plate 16 positioned on frame 15, in accordance with the principle of the invention. Bolts 23 and 13 are preferably sunk, although they can be countersunk or inwardly recessed, if desired. FIG. 2 illustrates a recess formed into the inner side of frame 15, which is denoted at 26, and which runs around perimeter frame 15 of plate 14 and at which fasteners, such as bolts 23, are positioned to secure adjacent plates and/or frames. Plates 17 and 20 are also preferably formed with a similar recess and their respective perimeter frames for at which fasteners are positioned for securing adjacent plates and/or frames.

Referring now to FIG. 3, which is a sectional view taken along line b-b of FIG. 1, there is illustrated the connection between adjacent plates 17, with the understanding the a plurality of such connection points are used in conjunction therewith, in which the structure of only one connection point is shown for illustrative purposes. In this embodiment, a fastener fastens together opposed perimeter frames 18 of plates 17, respectively, in which the fastener in this instance is a bolt 27 locked by a nut and being exemplary of a nut-and-bolt assembly although other mechanical fasteners may be used, if desired. It is to be understood that on lips 18A of perimeter frames 18 rest removable plates 19 and onto which equipment is to be set. Removable plates 19 may be formed with a perimeter rib and two-way sub-divider ribs (not shown) for enhanced strength.

FIG. 4 is a sectional view taken along line c-c of FIG. 1, which illustrates the seismic isolation system constituting a sub-assembly 30 of access floor assembly 10 shown in FIG. 1. For reference and understanding, it is to be understood that the height of the access floor assembly 10 is denoted at H and its thickness is denoted at T, which, in this specific embodiment, is about 1.5 inches. Beneath access floor assembly 10 is the vertical clearance/space for pipes, ducts, conduits and cables.

The main component of the illustrated isolation system at assembly 10 comprises opposing plates 31 and 11 and ball 12 disposed therebetween, and it is to be understood that the ensuing discussion of the isolation system at assembly 10 respecting each isolator plate 11 applies to each isolator plate 11. Plates 11 and 31 are load-bearing plates having concave cavities 11A and 31A, respectively, which face inwardly toward one another capturing ball 12 therebetween. Ball 12 can be rigid, and in another embodiment can be constructed and arranged having plasticity and elasticity. The combination of cavities 11A and 31A and ball 12 provide bearing re-centering after seismic activity passes and ball 12 provides and ensures damping and reduction in the seismic displacement of plates 11 and 31 relative to each other, as well as a reduction in the settling time of plates 11 and 31 after seismic displacement, in accordance with the principle of the invention. In a preferred embodiment, ball 12 is made of elastomeric material or composite material with an elastomer provided as one or more applied layers and/or as a core positioned within ball 12, which enhances the ability of ball 12 to provide damping and re-centering. Due to the combination of concave cavities 11A and 31A and ball 12 captured therebetween, isolator plate 11 displaces laterally up to distance A and rises by up to twice the depth of its concave cavity thus providing lateral and vertical displacement.

System 30 in FIG. 4 is a gravity restoring isolation system, in which ball 12 interacting with cavities 11A and 31A of plates 11 and 31 allows plate 31 to displace relative to plate 11 providing seismic isolation to not only plate 11 but also the plates attached to it, whether directly or by way of frames onto which plates are set. The displacement of plate 31 relative to isolator plate 11 constitutes a decoupling of plates 11 and 31 from their normal resting positions, which reduces the seismic acceleration transmitted from the base floor to the payload on access floor assembly 10. As such, equipment may be placed onto the access floor 10' without having to fasten it down and being, nevertheless, protected from seismic overturning by reduced base shear, in accordance with the principle of the invention. The isolation system described herein is automatic requiring no external energy input for functioning. Isolator plate 11 may be considered a second plate or upper or top plate or isolated plate. Plate 31 may be considered a first plate or lower or bottom plate or isolation plate or bearing plate.

Bearing plate 31, in addition to each bearing plate associated with its respective isolator plate, is supported by a substructure or understructure, which rests on base floor 37. The substructure or understructure consists of pedestals which are anchored to base floor 37 and to bearing plate 31. Opposing pairs of the pedestals associated with each bearing plate 31 are preferably coupled together with at least one brace 38. The pedestals are preferably structurally identical, and different geometries can be used, if desired, consistent with the teachings set forth herein.

In the present embodiment, pedestals are identical to one another each having a top plate 40, which is fastened to the underside of bearing plate 31. Top plate 40 is rigidly coupled to bearing plate 31 with, for instance, a suitable adhesive, and/or one or more screws, bolts, nut-and-bolt assemblies, etc. Top plate 40 may, if desired, be welded to the underside of bearing plate 31. Top plate 40 is rigidly secured to a relatively short threaded stem 32 that depends downwardly therefrom to a distal end 34 which projects through a threaded nut 33 positioned atop an upper end 35A of upright stud 35, and also is partially received into upper end 35A of an upright stud 35. Threaded nut 33 threadably retains stem 32 at upper end 35A of stud 35. Lower end 35B of stud 35 is rigidly affixed to a load distributor plate 36 positioned against base floor 37. Stem 32 is reciprocally adjustable relative to stud 35, in which nut 33 is used to secure stem 32 at whatever position it is adjusted to and thus providing height adjustment for plate 31 for setting the access floor at a specified height. Stem 32 and stud 35 have complementing cylindrical shapes in the preferred embodiment, but can be provided in other complementing shapes, such as square, triangular, etc. Also, although nut 33 is used to secure stem 32 to stud 35, other forms of mechanical devices can be used for providing this function, such as a clamp, a keyed nut, etc.

The bracing between opposing pairs of pedestals is provided by at least one brace 38, which is an elongate rigid member made of steel, aluminum, titanium or the like, being strong and highly resilient. Brace 38 has opposing ends 38A and 38B to which are attached connector plates 39, respectively, which are fastened, such as by welding, screwing, bolting, or the like, to the opposing studs of an opposing pair of pedestals. Plate 31 is preferably supported by four equally spaced-apart pedestals, although less or more can be used, if desired. That fact illustrates the economy of the access floor isolation system disclosed herein, which needs no beams and heavy-duty isolators. The greatly reduced price of the isolator type illustrated in FIG. 4 ensures such economy and the feasibility of the access floor configurations disclosed and illustrated herein.

In order to adapt prior art floor studs to suit the need of this invention, plate 40 may need to be reconfigured. Examples of such reconfigurations of plate 40 illustrated in FIGS. 5, 6 and 7.

Figure 5:
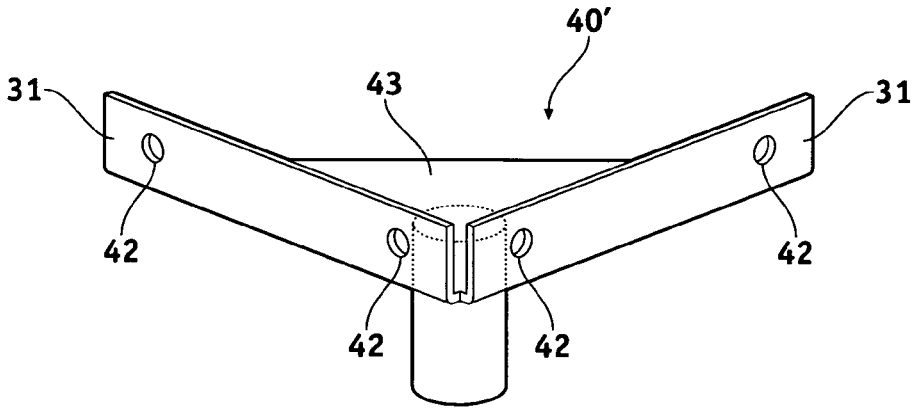
FIGS. 5-7 are perspective views of preferred embodiments of top plates for use with the seismic isolation apparatus of the access floor of FIG. 1.

FIG. 5 illustrates a preferred embodiment of a reconfiguration of plate 40 being a stud head 40', having a triangular support member 43 and opposed upturned sides 41 disposed in orthogonal directions, and which are fashioned with fastener attachment holes 42 used to receive fasteners for attachment to a bearing plate. Support member 43 is welded to a stem 44, which is to be attached to an upright stud as previously discussed.

Figure 6:
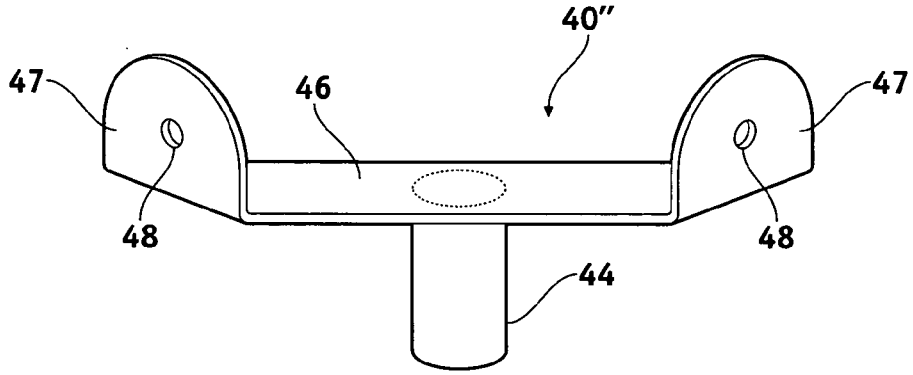

FIG. 6 illustrates another reconfiguration of plate 40" being a head including an elongate support 46 with a stem 44 rigidly affixed thereto, such as by welding or the like, at an intermediate location. Upturned tabs 47 with fastener holes 48, respectively, are located at each end of support 46. Tabs 47 are diagonal relative to one another, so that they may be bolted to the adjacent edges of a bearing plate, such as bearing plate 31 (not shown in FIG. 6). Stem 44 is to be attached to an upright stud as previously discussed.

Figure 7:
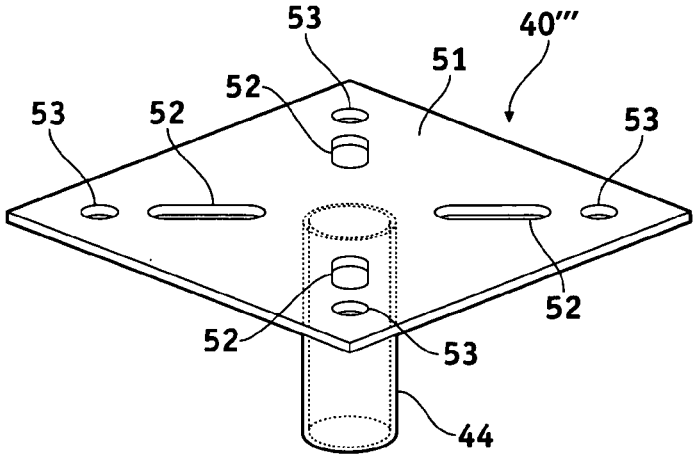

FIG. 7 illustrates yet another reconfiguration of late 40'" being a head including a plate 51 formed with stiffening ribs 52, and four fastener holes 53 disposed at the four corners of plate 51 being square in shape in this embodiment, and which accommodate fasteners for securement to a bearing plate. Plate 51 is rigidly fastened to stem 44, although it can be rigidly attached in other ways. Stem 44 is to be attached to an upright stud as previously discussed.

Figure 8:
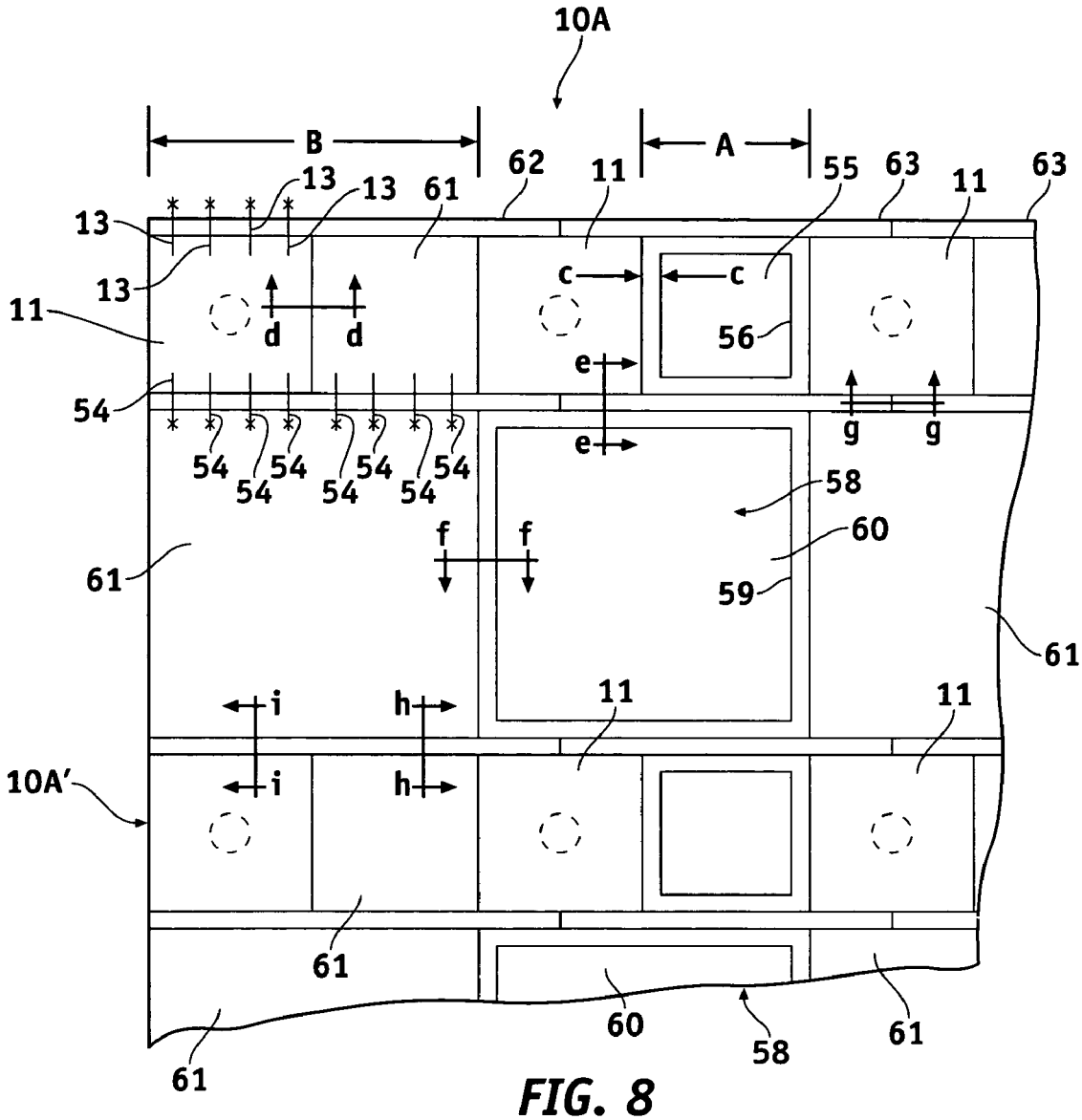
FIG. 8 is a top plan view of a seismic isolation access floor assembly, which is constructed and arranged in accordance with an alternate embodiment of the invention.

FIG. 8 is a perspective view of another preferred embodiment of a seismic isolation access floor assembly 10A incorporating isolator plates 11, each forming a seismic isolation component as previously discussed in conjunction with FIG. 4, and the other floor plates as previously discussed in conjunction with the embodiment designated 10 forming an access floor 10A', and also in-plane stringers 62 and 63, which form a narrow (size A+2C) and a wide (size B) floor area or strips of floor. In the narrow strip, floor plates 61 are not removable, and yet floor plates 55 are being supported on a perimeter frame 56. Stringers 62 and 63 are attached, such as by bolts 13, to isolator plates 11 on the exterior and by bolts 54 on the interior. Floor plates 61 are not removable in the wide strip, but floor plates 58 each have a perimeter frame 59 onto which is set removable floor plate 60.

At an infield of access floor 10A' stringers 63 are spliced across plates 11, while at the outfield or at the edge of access floor 10A' shorter stringers 62 are used un-spliced. FIGS. 9-14 illustrate sectional views taken along lines d-d, e-e, f-f, g-g, h-h and i-i, respectfully, illustrating the connections of the main components of floor assembly 10A. In order to ensure stability of floor assembly 10A in case most of plates 58 are removed for service, some plates 61 need to remain bolted at all times.

Figure 9:
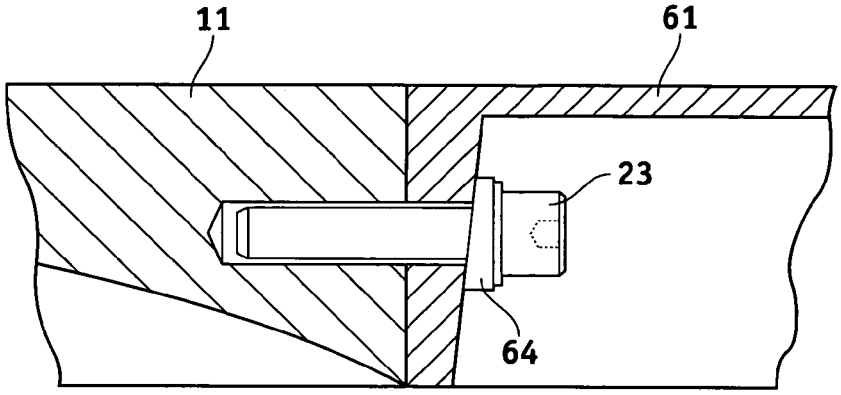
FIG. 9 is a sectional view taken along line d-d of FIG. 8.

FIG. 9 is a sectional view taken along line d-d of FIG. 8 illustrating a moment connection of isolator plate 11 to plate 61, with the understanding the a plurality of such connection points are used in conjunction therewith, in which the structure of only one connection point is shown for illustrative purposes. Here, a bolt 23 connects isolator plate 11 to directly to floor plate 61, which is shouldered by wedge washer 64.

Figure 10:
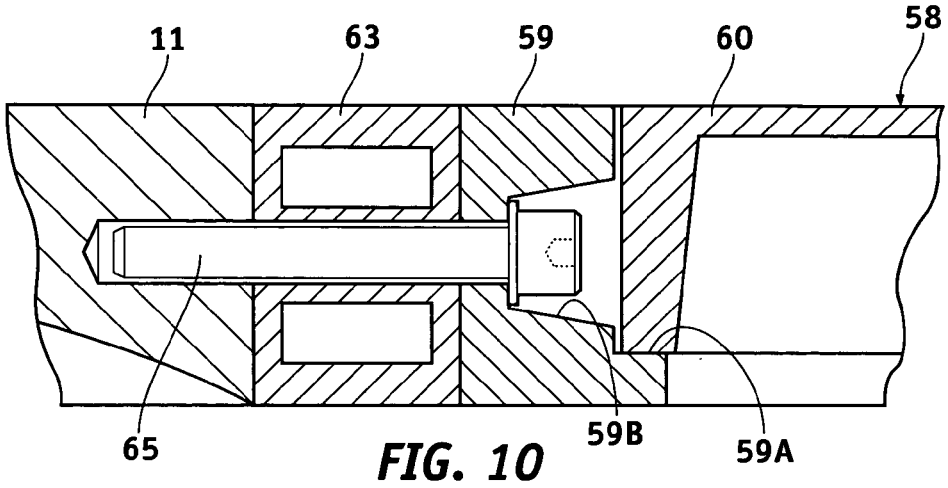
FIG. 10 is a sectional view taken along line e-e of FIG. 8.

FIG. 10 is a sectional view taken along line e-e of FIG. 8 illustrating a connection of stringer 63 to isolator plate 11 and perimeter frame 59 to stringer 63 using bolt 65, with the understanding the a plurality of such connection points are used in conjunction therewith, in which the structure of only one connection point is shown for illustrative purposes. Plate 60 is set onto frame 59 forming floor plate 58, which is actually a floor plate assembly. In this regard, floor plate 60 rests on lip 59A of perimeter frame 59. The head of bolt 59 is recessed in a groove 59B formed into frame 59.

Figure 11:
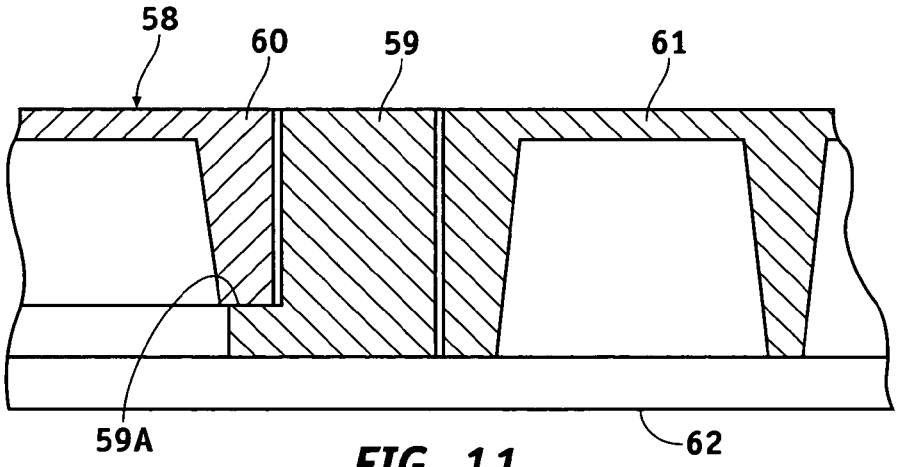
FIG. 11 is a sectional view taken along line f-f of FIG. 8.

FIG. 11 is a sectional view take along line f-f of FIG. 8, which illustrates a non-connected association of plates 58 and 61, where plate 61 is bolted to stringer 62 (not shown) and plate 60 is positioned onto lip 59A of perimeter frame 59.

Figure 12:
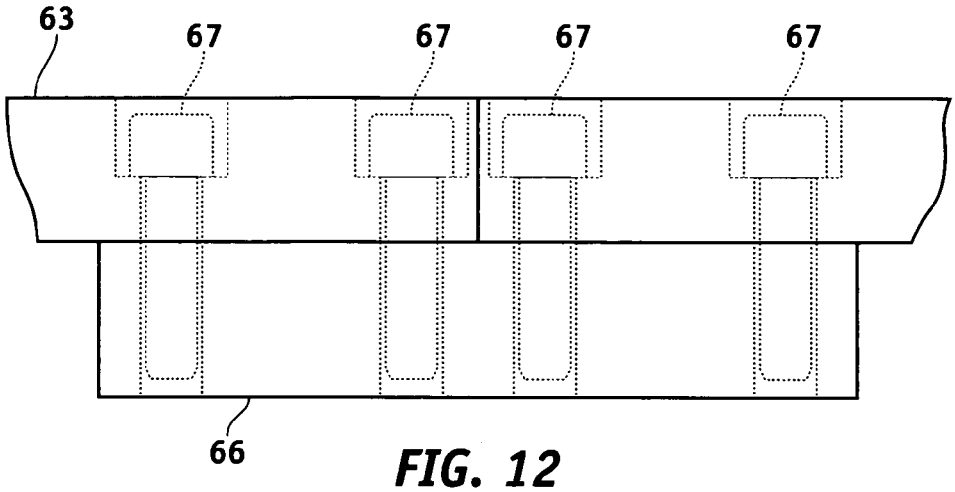
FIG. 12 is a sectional view taken along line g-g of FIG. 8.

FIG. 12 is a sectional view taken along line g-g of FIG. 8 illustrating the splice of stringers 63, which splice is identical to the splice of stringers 62 (not shown). The splice is a moment connection ensured by auxiliary short stinger 66 and bolts 67. Stringers 62 and 63 can be moment connected in line without stringer 66 as well. Stringer 66 is not in the way of the seismic movement of isolator plate 11 (not shown) relative to its corresponding bearing plate 31 (not shown). Stringers 62 and 63 can be several times longer than dimension B previously denoted, if desired.

Figure 13:
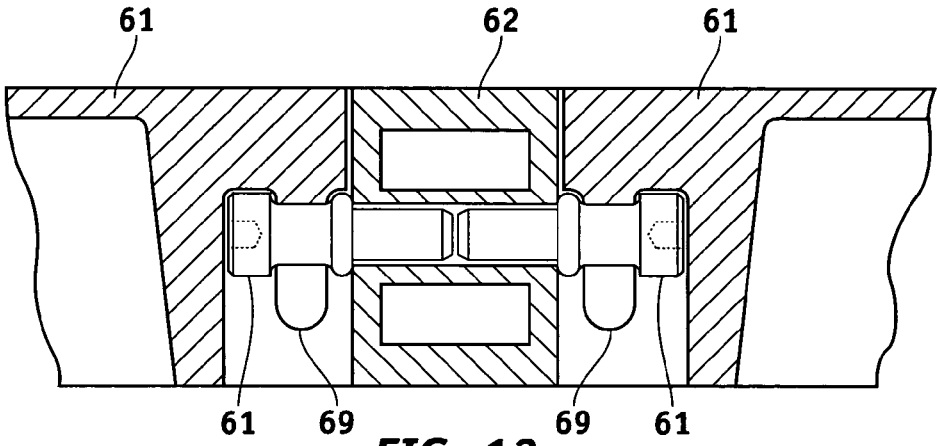
FIG. 13 is a sectional view taken along line h-h of FIG. 8.
Figure 14:
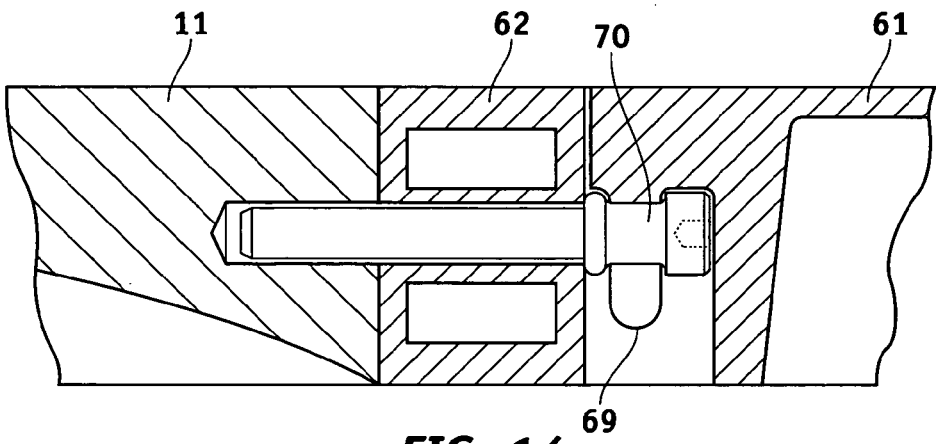
FIG. 14 is a sectional view taken along line i-i of FIG. 8.

FIG. 13 is a sectional view taken along line h-h of FIG. 8 illustrating a pinned connection of stringer 62 to plates 61 on each side using specialized screws 68, which are positioned into specially formed keyholes 69 of the perimeter ribs of plates 61, with the understanding the a plurality of such connection points are used in conjunction therewith, in which the structure of only one connection point is shown for illustrative purposes. FIG. 14 is a sectional view taken along line i-i of FIG. 8 illustrating a moment connection of isolator plate 11 to stringer 62 with a specialized bolt 70, and a pinned connection of plate 61 to stringer 62 using bolt 70, in which plate 61 has a recess 69 formed in a perimeter rib of plate 61 that accepts a head 70A of bolt 70, with the understanding the a plurality of such connection points are used in conjunction therewith, in which the structure of only one connection point is shown for illustrative purposes.

Figure 15:
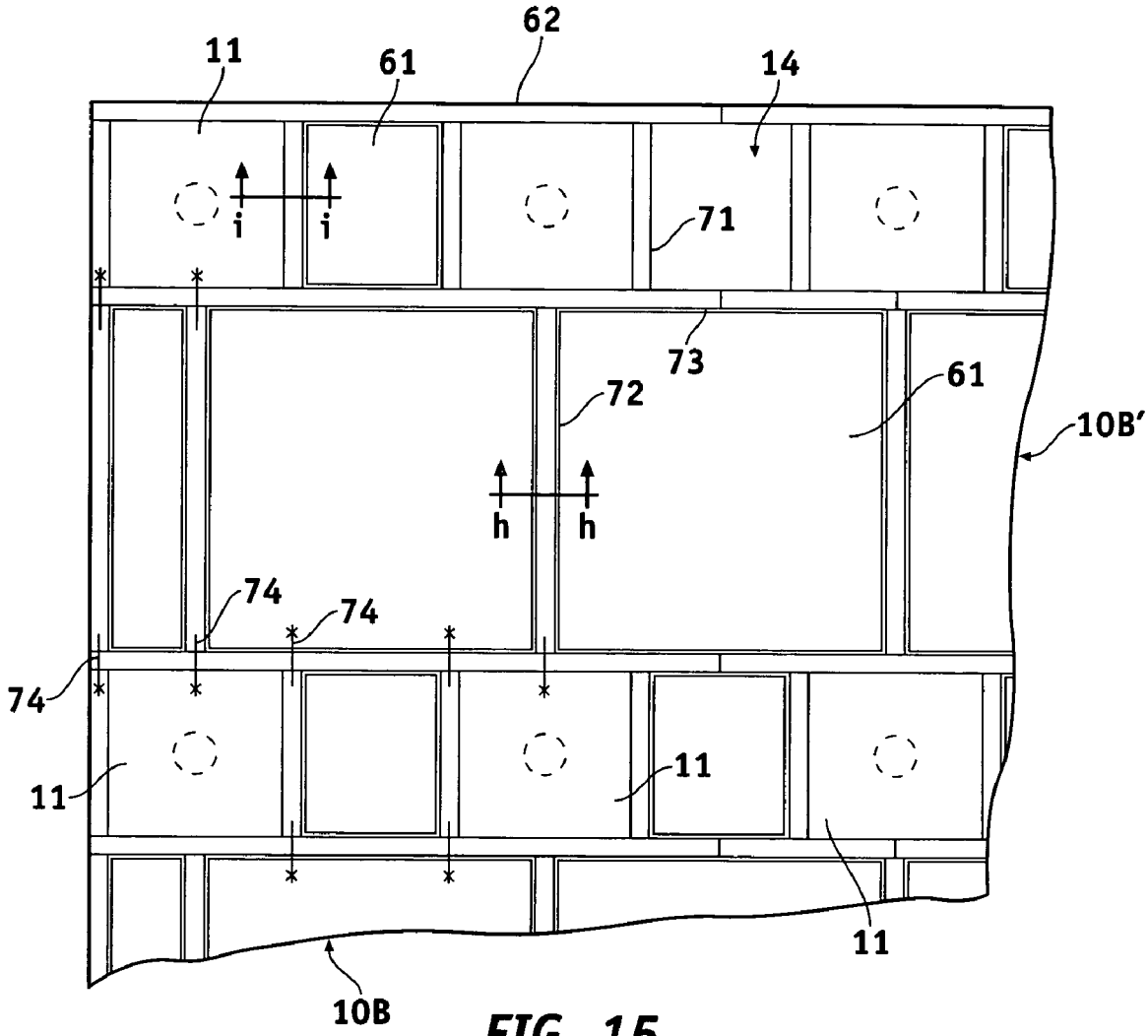
FIG. 15 is a top plan view of a seismic isolation access floor assembly, which is constructed and arranged in accordance with yet another alternate embodiment of the invention.
Figure 16:
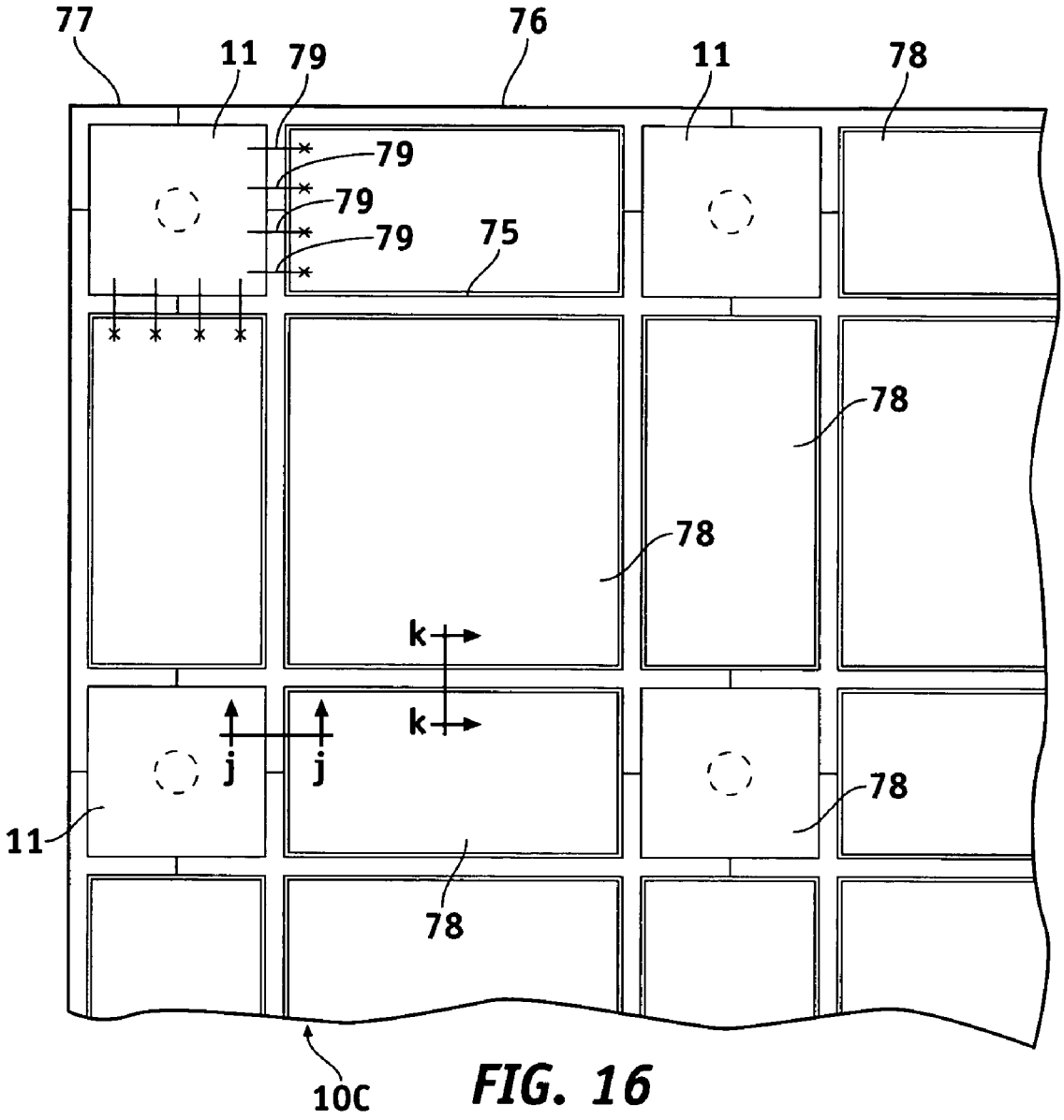
FIG. 16 is a top plan view of a seismic isolation access floor assembly, which is constructed and arranged in accordance with yet still another alternate embodiment of the invention.
Figure 17:
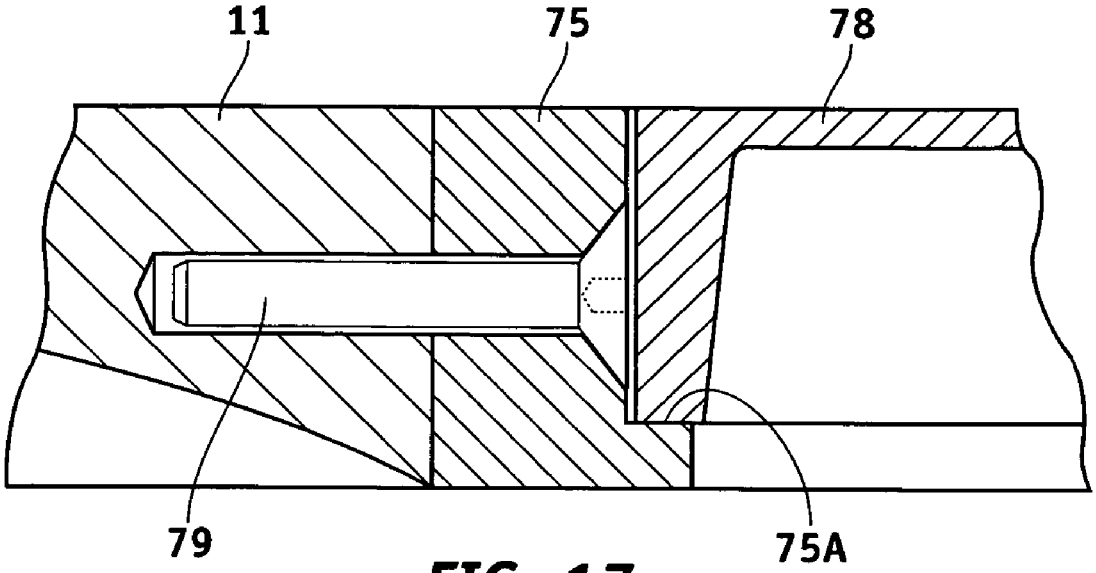
FIG. 17 is a sectional view taken along line j-j of FIG. 16.

FIG. 15 illustrates a top plan view of yet another preferred embodiment of a seismic isolation access floor assembly 10B that like assembly 10A incorporates isolator plates 11, each forming a seismic isolation component as previously discussed in conjunction with FIG. 4, and the other floor plates including floor plates 14 as previously discussed, and also stringers 62, 63, 71 and 72 as in-plane framing supporting inset removable floor plates 61, and together forming an access floor 10B'. The stringers in access floor assembly 10B are spliced by splice 73 either in line or similarly to the splice shown in FIG. 12. Any auxiliary elements in splice 73 do not hit plate 31 at seismic movement of access floor 10B'. FIGS. 16 and 17 are sectional views taken along lines h-h and i-i, which are shown in FIGS. 13 and 14, respectively. Countersunk bolts 74, denoted generally in FIG. 15, ensure moment connections between the stringers, which meet perpendicularly as illustrated.

Figure 18:
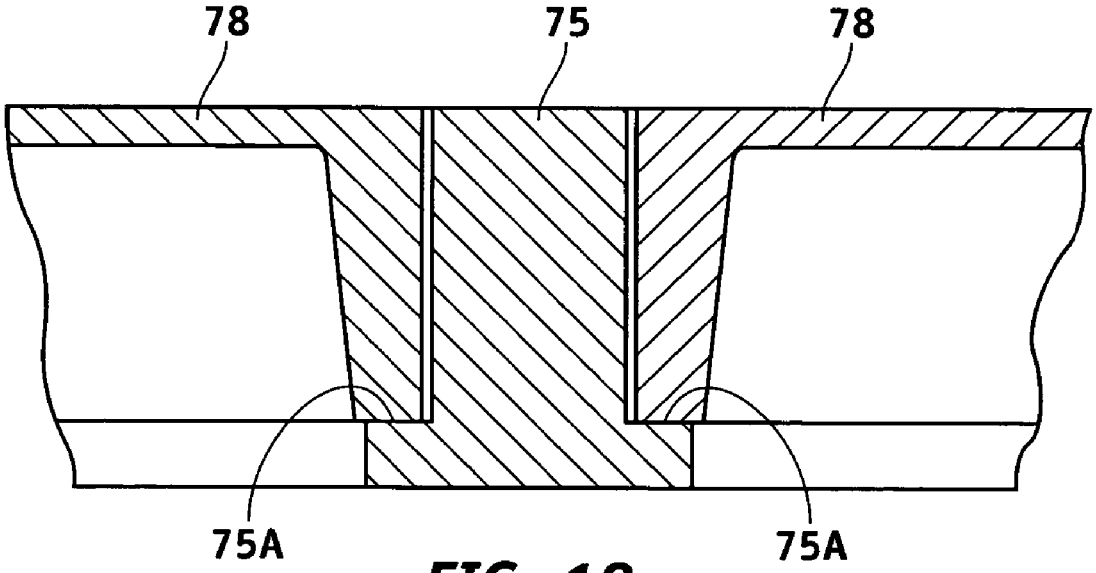
FIG. 18 is a sectional view taken along line k-k of FIG. 16.

FIG. 16 illustrates in top view yet another preferred embodiment of a seismic isolation access floor assembly 10C that, in common with assembly 10B, incorporates isolator plates 11, each forming a seismic isolation component as previously discussed in conjunction with FIG. 4, and floor plates 14 and 61 and also perimeter stringer frames 75, 76 and 77 which are welded or cast framing members supporting removable floor plates 78. FIGS. 17 and 18 are sectional views taken along lines j-j and k-k, respectively, of FIG. 16, illustrating moment and pinned connections, respectively.

FIG. 17 is a sectional view taken along line j-j of FIG. 16 illustrating a moment connection of plate 11 and perimeter frame 75 using countersunk bolt 79. Removable floor plate 78 rests on a lip 75A of frame 75, in which frame 75 and plate 78 form a floor plate or plate assembly. FIG. 18 is a sectional view taken along line k-k of FIG. 16 illustrating the connection of frame 75 and removable floor plates 78 resting on lips 75A of frame 75.

Figure 19:
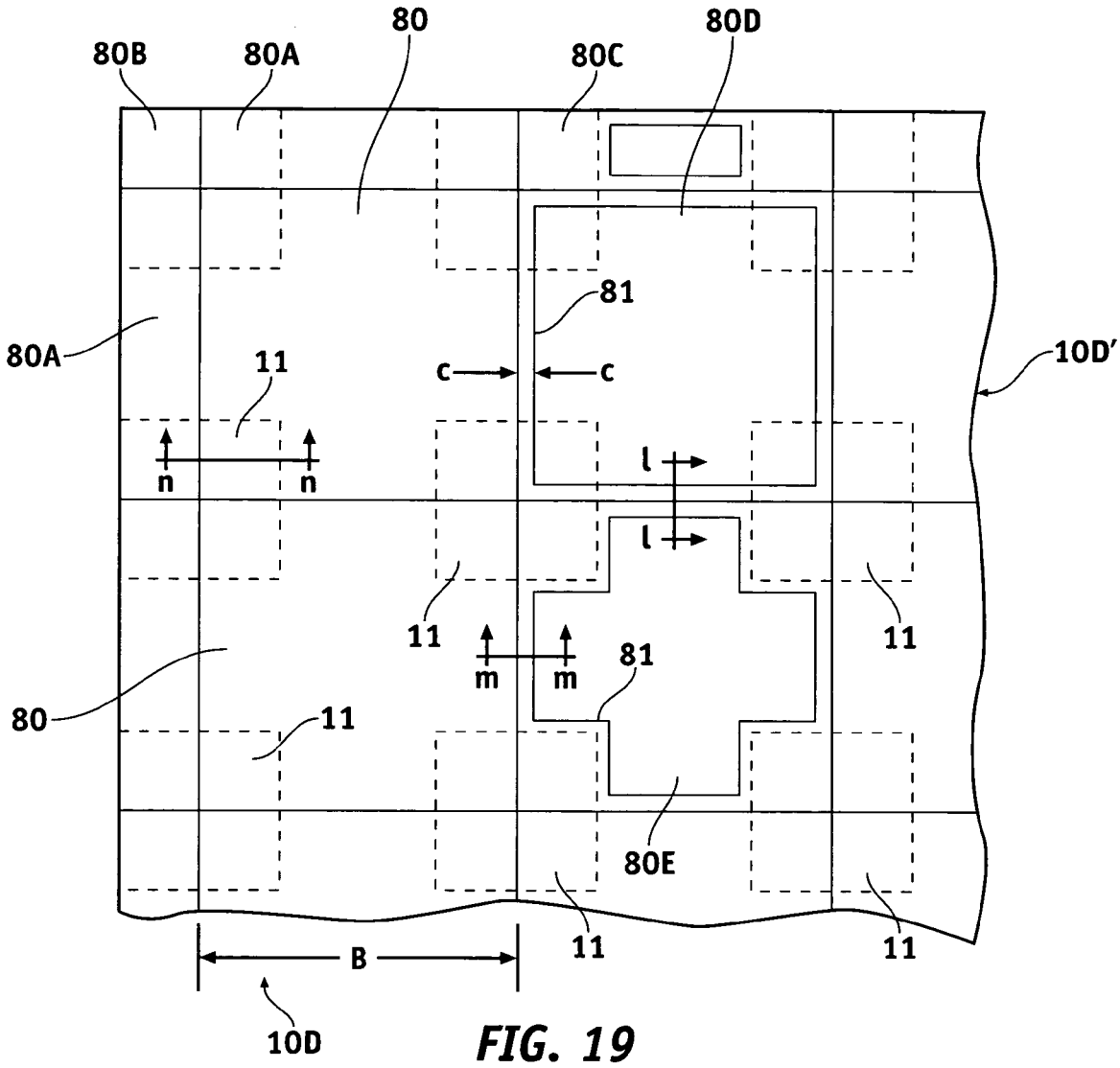
FIG. 19 is a top plan view of a seismic isolation access floor assembly, which is constructed and arranged in accordance with a further alternate embodiment of the invention.
Figure 20:
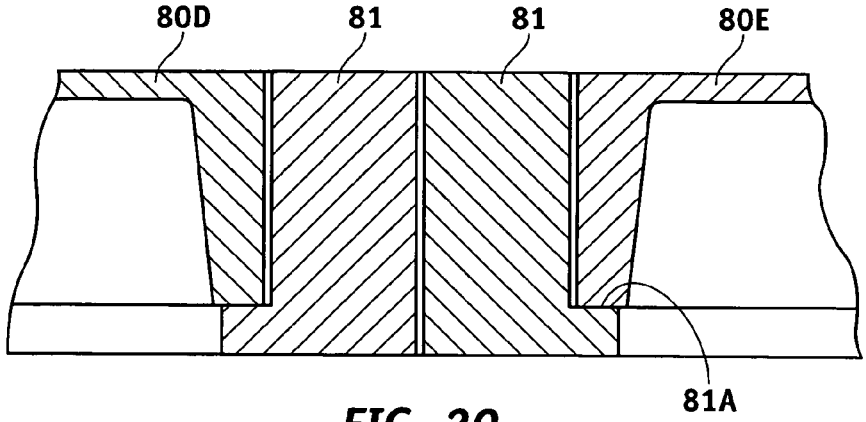
FIG. 20 is a sectional view taken along line l-l of FIG. 19.
Figure 21:
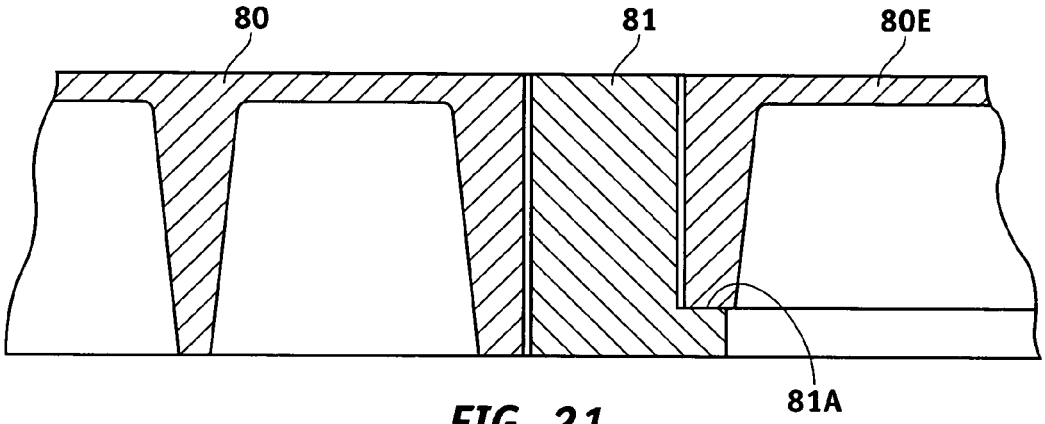
FIG. 21 is a sectional view taken alone line m-m of FIG. 19.
Figure 22:
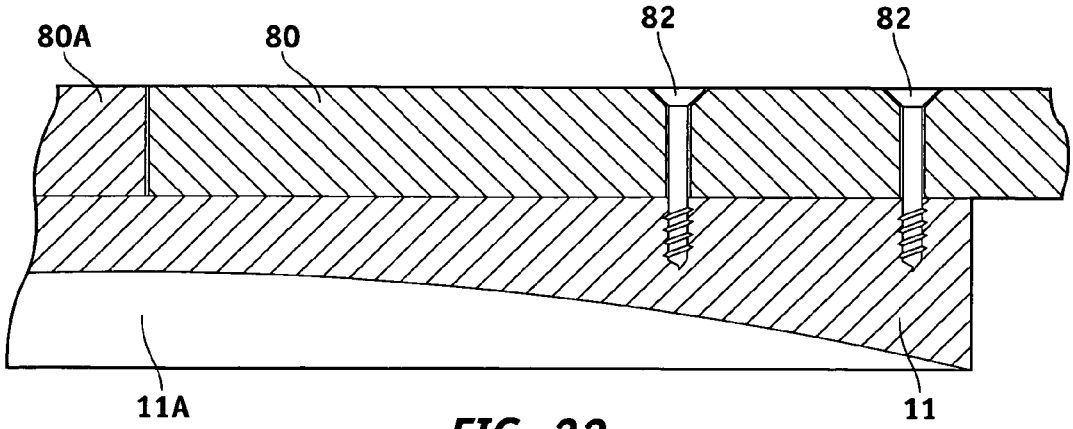
FIG. 22 is a sectional view taken along line n-n of FIG. 19.

FIG. 19 is a top plan view of yet another preferred embodiment of a seismic isolation access floor assembly 10D incorporating isolator plates 11, each forming a seismic isolation component as previously discussed in conjunction with FIG. 4, and floor plates forming an access floor 10D', and which is furnished without stringers, in which floor plates 80 of size B rest attached on isolator plates 11, in accordance with the principle of the invention, in which isolator plates are shown in phantom outline for illustrative purposes. The clear vertical space of access floor 10D' above the base floor (not shown) is similar to that as shown in FIG. 4. Isolator plates 11 occupy some useful area of plates 80, but the connection of plates 11 and 80 is simple and inexpensive. The corners of plates 80 are fastened, such as with screws or bolts, to isolator plates 11. On the perimeter of access floor 10D plates 80 are cut smaller forming a side plates 80A, corner plates 80B and plate 80C being a side with removable floor plate 80D. Some or all of plates 80 each can have perimeter frame 81 of width C, thus allowing holding by gravity of removable floor plates 80D or 80E, where these plates differ only in shape. FIGS. 20-22 are sectional views taken alone lines l-l, m-m and n-n of FIG. 19, respectively, illustrating connections of the floor plates of assembly 10D.

FIG. 20 is a sectional view taken along line l-l of FIG. 19 illustrating a connection of plates 80D and 80E, in which perimeter frames 81 are positioned against one another and onto which are set plates 80D and 80E, respectively. FIG. 21 is a sectional view taken along line m-m of FIG. 10 illustrating the connections of floor plate 80 to floor plate 80E, in which plate 80 is presented up against one side of frame 81 and frame 81 has a lip 81A onto which plate 80E is set on the other side of frame 81. FIG. 22 is a sectional view taken along line n-n of FIG. 19 illustrating a moment connection of isolator plate 11 to plates 80 and 80A with, as a matter of example, self tapping screws 82.

Figure 23:
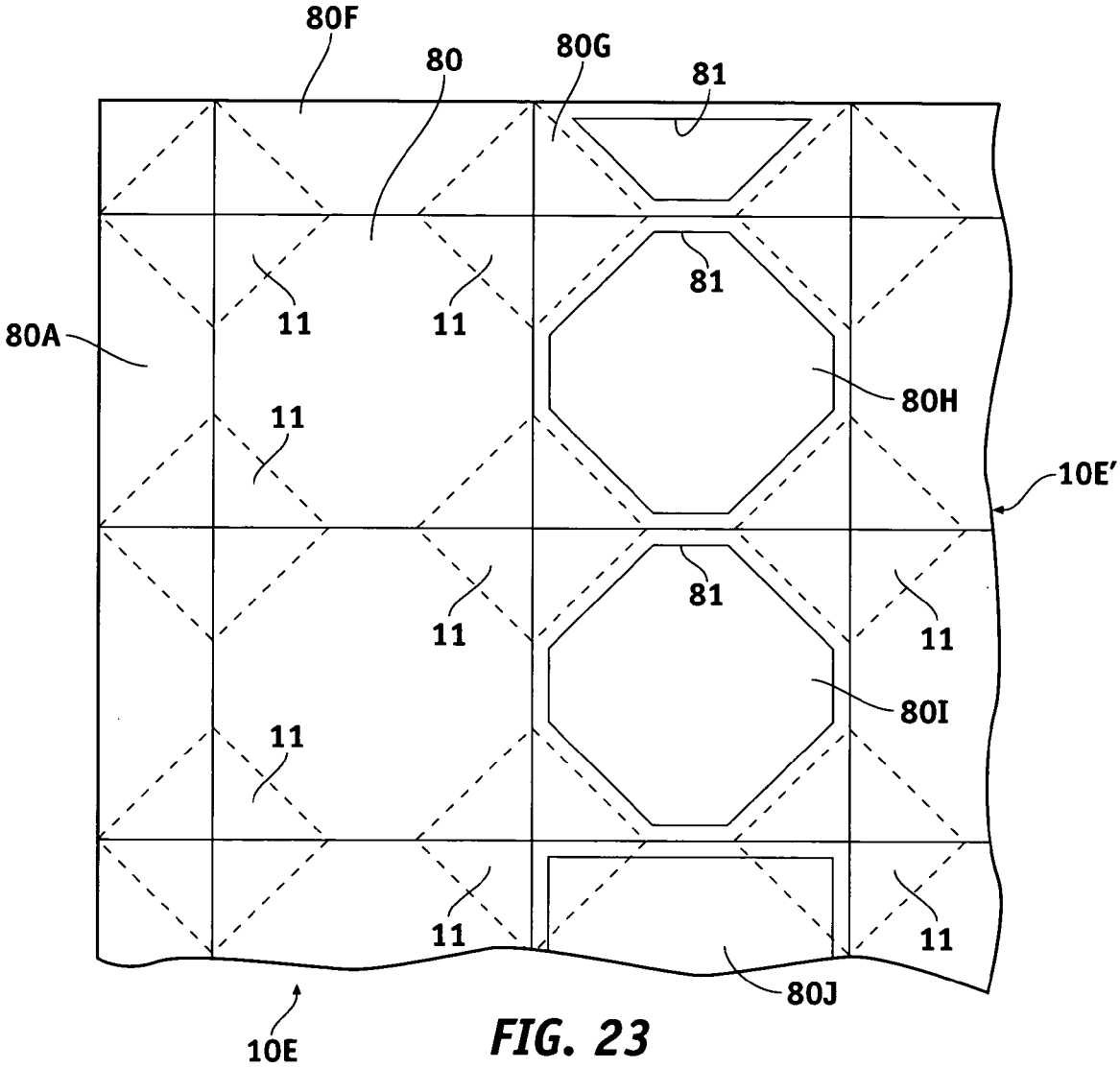
FIG. 23 is a top plan view of a seismic isolation access floor assembly, which is constructed and arranged in accordance with yet a further alternate embodiment of the invention.

FIG. 23 is a top plan view yet another preferred embodiment of a seismic isolation access floor assembly 10E incorporating isolator plates 11, each forming a seismic isolation component as previously discussed in conjunction with FIG. 4, and floor plates 80 together forming an access floor 10E', in which isolator plates 11 are turned in diagonally allowing for larger accessible area in, for instance, floor plates 80G, 80H, 80I and 80J, all of which have a perimeter frame 81 therearound and with corner reinforcement. Floor plates 80A and 8OF on the perimeter of assembly 10E are concurrently non-removable.

Figure 24:
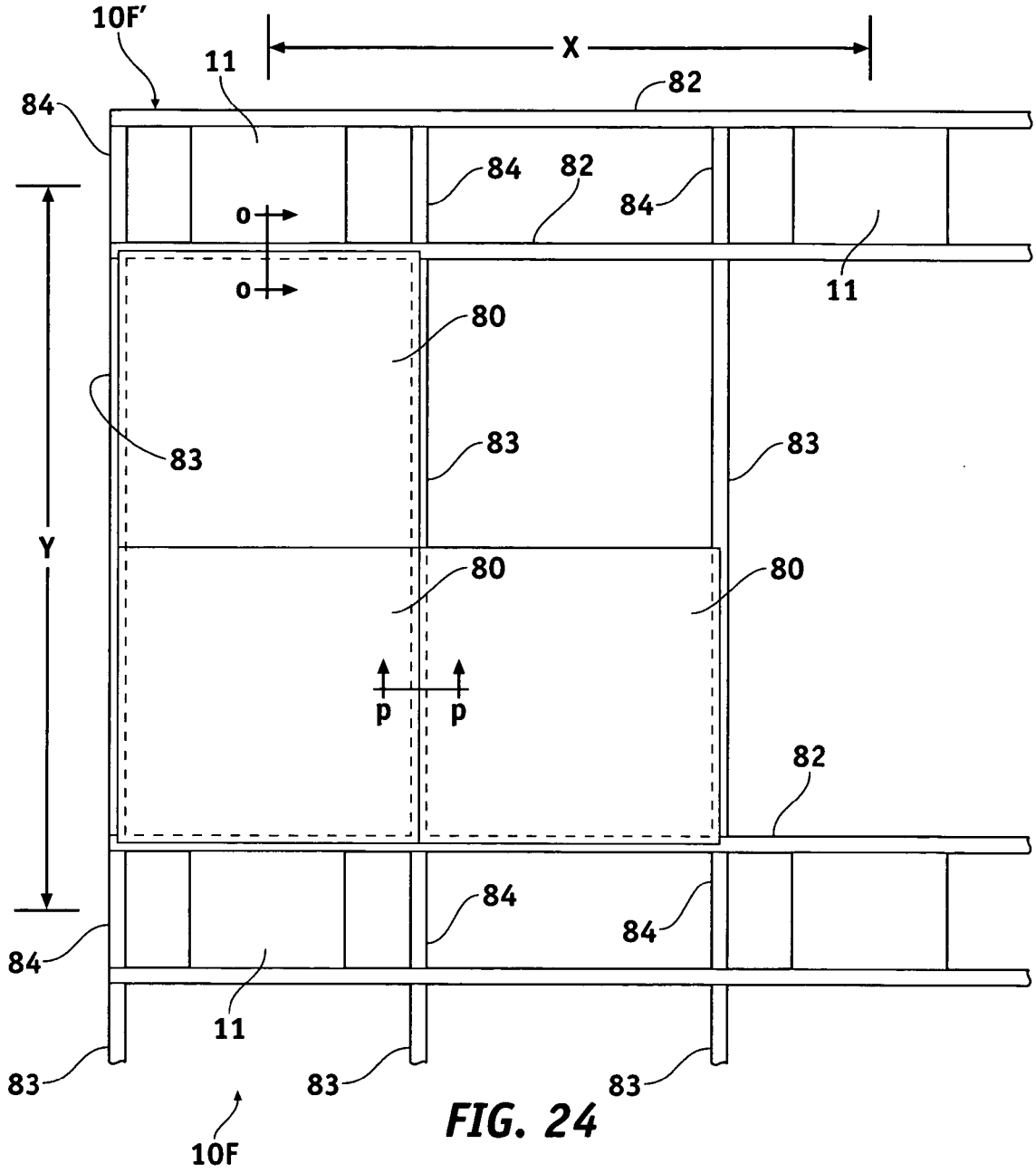
FIG. 24 is a top plan view of a seismic isolation access floor assembly, which is constructed and arranged in accordance with yet still a further alternate embodiment of the invention.
Figure 25:
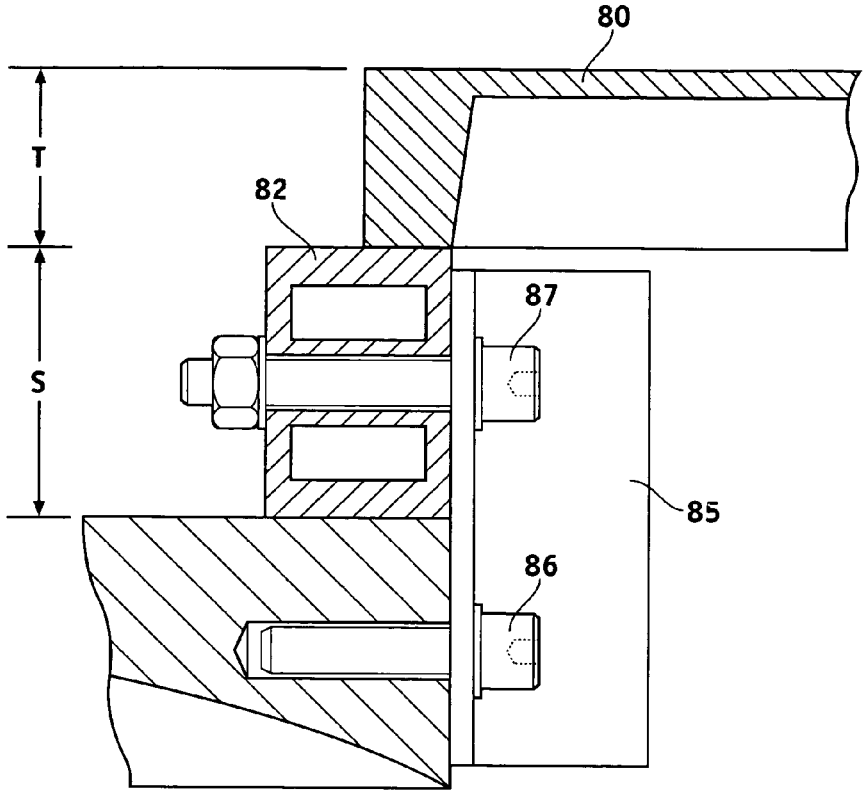
FIG. 25 is a sectional view taken alone line o-o of FIG. 24.
Figure 26:
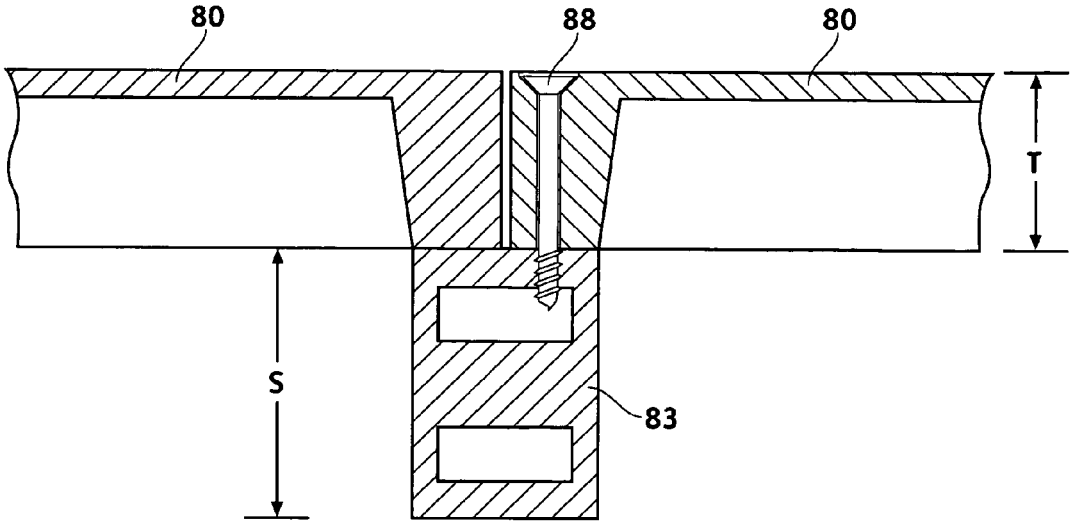
FIG. 26 is a sectional view taken along line p-p of FIG. 24.

FIG. 24 is a top plan view of yet another preferred embodiment of a seismic isolation access floor assembly 10F with X-directional stingers 82 mounted on top of isolator plates 11, each forming a seismic isolation component as previously discussed in conjunction with FIG. 4, and Y-directional stringers 83 between stringers 82 to support floor plates 80, in which isolator plates 11 and floor plates 80 and stingers 82 and 83 form an access floor 10F'. FIGS. 25 and 26 are sectional views taken along lines o-o and p-p, respectively, of FIG. 24 illustrating the stringer 82 to isolator plate 11 moment connection and the floor plate 80 to stringer 83 pinned simple support connection, respectively. Since stringers 82 and 83 are superimposed on isolator plate 11, in this embodiment the vertical clearance of assembly 10F is H−(T+S), where S is the depth of the stringers. The stringers and floor plates have more distributed supports, and dimensions T and S can be reduced or X and Y increased. Such increase would reduce understructure requirement although not in total load bearing capacity.

FIG. 25 is a sectional view taken alone line o-o of FIG. 24 illustrating a preferred attachment of stringer 82 to isolator plate 11 using angle plate 85, in which stringer 82 is set onto isolator plate 11 and cap screw 86 secures an end of angle plate 85 to isolator plate 11 and bolt 87 secures an opposing end of angle plate 85 to stringer 82, with the understanding the a plurality of such connection points are used in conjunction therewith, in which the structure of only one connection point is shown for illustrative purposes. Laid on top of stringer 82 is floor plate 80, which is held there by gravity. FIG. 26 is a sectional view taken alone line p-p of FIG. 24 illustrating two floor plates 80 mounted over stringer 83, in which one of the floor plates is secured by, for instance, a self tapping screw 88, with the understanding the a plurality of such connection points are used in conjunction therewith, in which the structure of only one connection point is shown for illustrative purposes.

Figure 27:
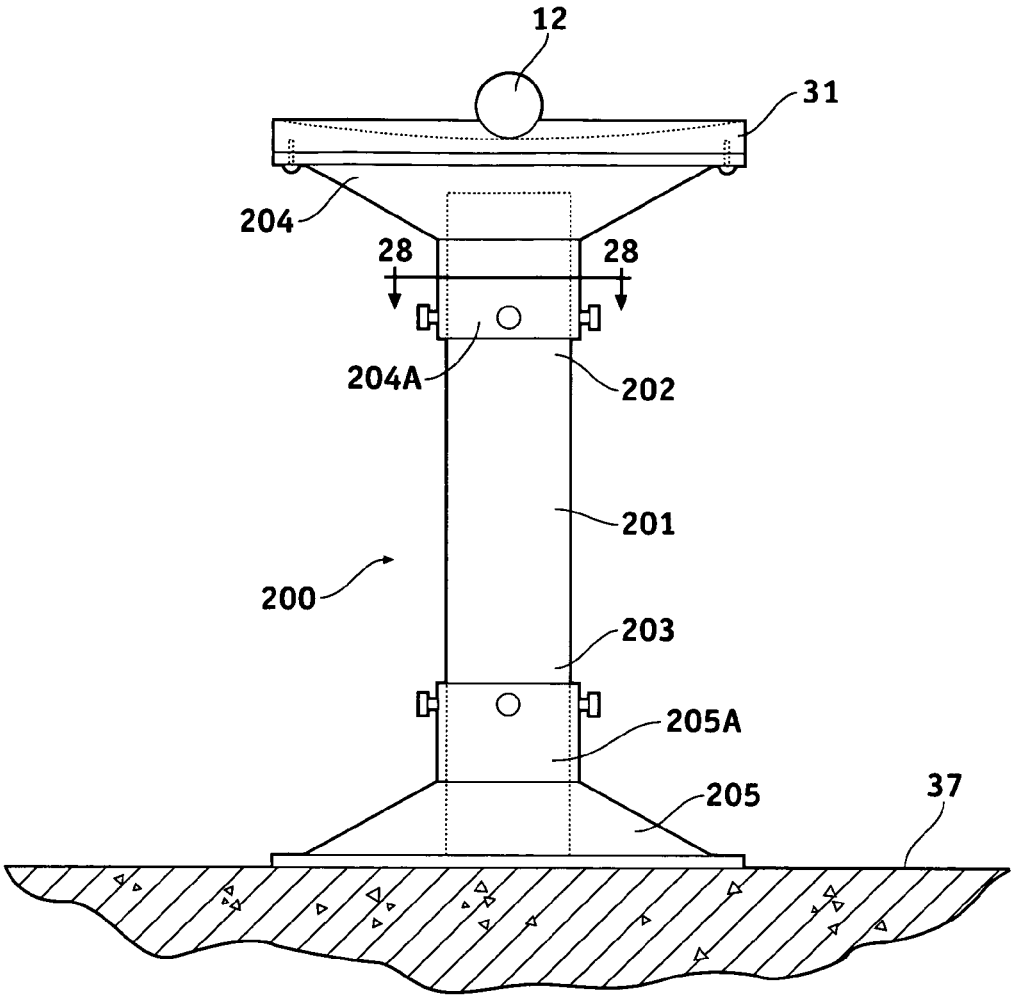
FIG. 27 is a side elevational view of a pedestal for use with a seismic isolation access floor assembly constructed and arranged in accordance with the principle of the invention.
Figure 28:
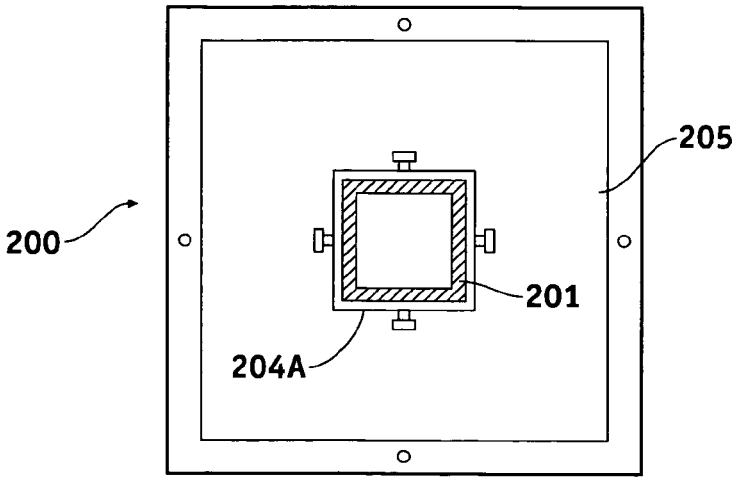
FIG. 28 is a sectional view taken along line 28-28 of FIG. 27.

The present invention is described above with reference to preferred embodiments. However, those skilled in the art will recognize that changes and modifications may be made in the described embodiments without departing from the nature and scope of the present invention. For instance, it is to be understood that the dimensions set forth herein are preferred dimensions, and that other dimensions may be used without departing from the nature and scope of the invention. Also, FIGS. 27 and 28 show another embodiment of a pedestal 200 that may be used for supporting a bearing plate 31 of an isolator component of an access floor assembly constructed and arranged in accordance with the principle of the invention. Referring first to FIG. 27, pedestal 200 is the single support structure for plate 31 including an elongate column 201 having opposing upper and lower ends 202 and 203. Upper end 202 is received into a socket 204A of an upper fixed base column support 204 and is secured thereto with screws or prying bolts. Lower end 203 is received into a socket 205A of a lower fixed base column support 205 and is secured thereto with screws or prying bolts. Plate 31 is set onto upper fixed base column support 204, and onto which ball 12 is set for receiving an isolator plate (not shown) thereon. Ball 12 is positioned on plate 31 for illustrative purposes and for reference and understanding. Lower fixed base column support 205 is positioned against base floor 37 and fastened thereto, such as with a suitable adhesive and/or one or more mechanical fasteners, welding, etc. As a matter of illustration, FIG. 28 is a sectional view taken along line 28-28 of FIG. 7 illustrating socket 204A and upper end 202 extending therethrough.

Also, the floor plates of the various embodiments of the invention may incorporate windows, doors, ventilation holes, grillage, or the like, if desired, including in their removable inserts should they be incorporated therewith.

Various further changes and modifications to the embodiment herein chosen for purposes of illustration will readily occur to those skilled in the art. To the extent that such modifications and variations do not depart from the spirit of the invention, they are intended to be included within the scope thereof.

The invention claimed is:

1. Apparatus, comprising:

a base floor;

a bearing plate; an isolator plate overlying the bearing plate;

a ball disposed between and contacting the bearing plate and the isolator plate;

at least one upstanding pedestal having an end coupled to the base floor and an opposing end coupled to the bearing plate;

the bearing plate disposed at an elevated location relative to the base floor; and the pedestal adjustable between shortened and lengthened conditions.

2. Apparatus according to claim 1, further comprising a floor plate coupled to the isolator plate and together forming an access floor disposed at an elevated location relative to the base floor.

3. Apparatus according to claim 1, further comprising a frame coupled to the isolator plate and capable of receiving and supporting a floor plate.

4. Apparatus according to claim 1, further comprising:

a frame coupled to the isolator plate; and a floor plate supported by the frame.

5. Apparatus according to claim 1, further comprising:

a substructure mounted to the base floor; and the bearing plate mounted to the substructure and disposed at an elevated location relative to the base floor.

6. Apparatus according to claim 5, wherein the substructure comprises at least one upstanding pedestal having an end coupled to the base floor and an opposing end coupled to the bearing plate.

7. Apparatus according to claim 6, wherein the pedestal is adjustable between shortened and lengthened conditions.

8. Apparatus according to claim 1, further comprising:

a first cavity formed into the bearing plate;

a second cavity formed into the isolator plate;

the first cavity confronting the second cavity; and the ball contacting first and second cavities.

9. Apparatus according to claim 8, wherein the first cavity is concave.

10. Apparatus according to claim 9, wherein the second cavity is concave.

11. Apparatus, comprising:

a base floor;

a bearing plate;

an isolator plate overlying the bearing plate;

a ball disposed between and contacting the bearing plate and the isolator plate;

at least one upstanding pedestal having an end coupled to the base floor and an opposing end coupled to the bearing plate;

the bearing plate disposed at an elevated location relative to the base floor;

the pedestal adjustable between shortened and lengthened conditions; and a first floor plate coupled to the isolator plate and together forming an access floor disposed at an elevated location relative to the base floor.

12. Apparatus according to claim 11, further comprising:

a frame coupled to the isolation plate; and the first floor plate supported by the frame.

13. Apparatus according to claim 11, further comprising a floor plate receiving frame coupled to the isolator plate.

14. Apparatus according to claim 13, further comprising a second floor plate supported by the floor plate receiving frame.

15. Apparatus according to claim 11, further comprising:

a substructure mounted to the base floor; and the bearing plate mounted to the substructure and disposed at an elevated location relative to the base floor.

16. Apparatus according to claim 15, wherein the substructure comprises at least one upstanding pedestal having an end coupled to the base floor and an opposing end coupled to the bearing plate.

17. Apparatus according to claim 16, wherein the pedestal is adjustable between shortened and lengthened conditions.

18. Apparatus according to claim 11, further comprising:

a first cavity formed into the bearing plate;

a second cavity formed into the isolator plate;

the first cavity confronting the second cavity; and the ball contacting first and second cavities.

19. Apparatus according to claim 18, wherein the first cavity is concave.

20. Apparatus according to claim 19, wherein the second cavity is concave.

21. Apparatus, comprising:

an assembly of attached isolator plates and floor plates together forming an access floor disposed at an elevated location relative to a base floor;

each of the isolator plates overlying a bearing plate coupled to a base floor and formed with a first cavity contacting a ball disposed on an opposed second cavity formed in the bearing plate;

the bearing plate mounted to a pedestal coupled to the base floor; and the pedestal adjustable between shortened and lengthened conditions.

22. Apparatus according to claim 21, further comprising the bearing plate associated with each of the isolator plates mounted to a substructure coupled to the base floor.

23. Apparatus according to claim 22, wherein the substructure comprises at least one pedestal.

24. Apparatus according to claim 23, wherein the pedestal is adjustable between shortened and lengthened conditions.

25. Apparatus according to claim 21, wherein the first cavity is concave.

26. Apparatus according to claim 25, wherein the second cavity is concave.

27. Apparatus according to claim 21, further comprising:

a frame attached to at least one of the isolator plates; and one of the floor plates supported by the frame.

* * * * *